US008376024B1

(12) United States Patent
Bates

(10) Patent No.: US 8,376,024 B1
(45) Date of Patent: Feb. 19, 2013

(54) FOUNDRY MOLD INSULATING COATING

(76) Inventor: Charles Earl Bates, Birmingham, AL (US)

( * ) Notice: Subject to any disclaimer, the term of this patent is extended or adjusted under 35 U.S.C. 154(b) by 0 days.

(21) Appl. No.: 13/341,986

(22) Filed: Dec. 31, 2011

(51) Int. Cl.
*B22C 3/00* (2006.01)
*B22D 13/00* (2006.01)

(52) U.S. Cl. ..... 164/72; 164/138; 164/114; 427/135

(58) Field of Classification Search ..... 164/14, 164/33, 72, 138, 159, 267, 114, 175, 286; 106/38.22; 427/133, 134, 135
See application file for complete search history.

(56) References Cited

U.S. PATENT DOCUMENTS

| | | | |
|---|---|---|---|
| 1,662,354 | A | 3/1928 | Williams |
| 1,949,433 | A | 3/1934 | Russell et al. |
| 2,882,568 | A | 4/1959 | Leaberry et al. |
| 3,326,270 | A | 6/1967 | Collins et al. |
| 3,437,131 | A | 4/1969 | Ornitz |
| 3,527,285 | A | 9/1970 | Webbere |
| 3,945,782 | A | 3/1976 | Farahar |
| 4,058,153 | A | 11/1977 | Pierrel |
| 4,116,260 | A | 9/1978 | Pierrel |
| 4,124,056 | A | 11/1978 | Noble |
| 4,370,719 | A | 1/1983 | Upchurch et al. |
| 4,448,610 | A | 5/1984 | Bellocci |
| 4,541,477 | A | 9/1985 | Fort et al. |
| 4,558,730 | A | 12/1985 | Yoshida et al. |
| 4,683,937 | A | 8/1987 | Hamill, Jr. et al. |
| 4,897,294 | A | 1/1990 | Libby et al. |
| 5,725,043 | A | 3/1998 | Schaefer et al. |
| 7,234,507 | B2 | 6/2007 | Jahedi et al. |
| 7,615,095 | B2 | 11/2009 | Margaria |

FOREIGN PATENT DOCUMENTS

| | | | |
|---|---|---|---|
| GB | 930391 | * | 7/1963 |

OTHER PUBLICATIONS

"Replacement of Zircon in the Foundry Industry", Jun. 2011, Danilo Frulli, All pp. 194-198.

* cited by examiner

*Primary Examiner* — Kevin P Kerns
(74) *Attorney, Agent, or Firm* — Kevin P. Weldon

(57) ABSTRACT

Tubular metal articles such as pipe and cylinder liners are produced by centrifugal casting on a permanent metal mold coated by refractory glass on the active surface. A coating suspension mix is evenly distributed onto the mold to form a uniform layer of insulation on the surface of the mold. The material for the coating comprises of essentially a waterborne suspension mix of glass particles. The suspension is given time to dry on the surface of the mold. The glass particles dispersed in the suspension are both non-crystalline and non-porous. The glass particles in the suspension and forming the coating are not dissolved and do not chemically attract the polar water molecule or cause it to bond to the surface of glass in the suspension or to the mold active surface. Articles cast as such are smooth surfaced and require only limited machining. The coating provides thermal protection to the mold, but more importantly, the water in the suspension vaporizes quickly on a warm mold because the water is not attracted or bonded to the refractory glass particles.

6 Claims, No Drawings

FOUNDRY MOLD INSULATING COATING

FIELD OF THE INVENTION

The present invention relates to a powder product designed to protect casting molds for making tubes or pipes of ductile iron or gray iron made by centrifugal casting process. The purpose of the invention is a powder product for the protection of centrifugal casting molds that evolves most or all of the suspension carrier liquid prior to the molten metal being applied. Evolution of the suspension carrier liquid prior to pouring molten metal minimizes or eliminates gas formed when the molten metal is poured onto the mold. This invention relates to a superior insulating coating for steel permanent molds.

BACKGROUND OF THE INVENTION

Casting products are made in molds by first preparing a mold which might be a metal permanent mold or a sand mold. Sand molds are destroyed when each casting is poured or otherwise applied thereto whereas permanent molds can be used to make many castings.

Permanent molds are used to make many parts of a single design. Permanent molds are commonly used to produce iron pipe, engine blocks, engine heads, cylinder liners and other metal products. These manufactured products must have a geometrical shape so that a mold can be machined out of steel, copper or other well known metal alloys employed for constructing molds in the industry.

In the casting process a cavity is first shaped in a mold. The mold inner cavity surface is the active surface and has a configuration corresponding to the exterior surface of the product desired to be manufactured. Molten metal is poured into the mold cavity and takes the shape of the cavity. As the metal cools it solidifies into a metal casting product having a shape corresponding to the mold cavity is produced.

Steel permanent molds are used to make millions of tons of pipe each year. The permanent molds are commonly made from steel alloys that may cost a pipe manufacturer upwards of $250,000.00 USD to purchase. The permanent mold for pipes may be used hundreds or thousands of times before thermal cracks develop on the cavity internal active surface due to the exposure of the active surface to the high temperature molten metal. The expensive mold may begin to leak and then it must be scrapped and taken out of service costing a business lost productivity. In the prior art insulating coatings have been applied to the active mold surface forming a thermal barrier that inhibits deterioration of the mold due to the overheating by the molten metal.

The insulating coatings slow down heat transfer to the mold. Thermal stress fractures will occur on the permanent metal mold with the life being shortened by higher heat transfer rates. The insulating coating reduces the heat transfer rate and extends the life of the mold by reducing the rate of thermal stress fracture formation.

The prior art insulating coatings are also useful as a coating for sand molds and cores to prevent the aluminum, bronze, gray iron, ductile iron, and steel from adhering to the sand mold or core.

The prior art employs an insulating coating to protect centrifugal casting molds used to produce centrifugally cast products. There are many prior art insulating coatings used on permanent molds, sand molds and sand cores. Commonly used coating refractory material in the prior art includes silica, mullite, andalusite, kaolinite, zircon, zirconia, diatomaceous earth, western bentonite, southern bentonite, specially treated high expansion bentonites, graphite, alumina and silica-alumina compounds. These are crystalline materials.

The prior art insulating coatings often include well known suspension agents to assist in maintaining the refractory materials in a uniformly distributed suspension during extended periods of storage prior to use. Further, many of the prior art insulating coatings include biocides to prevent fungal and plant growth during storage.

In prior art, stationary non-centrifugal molds, a slurry of a finely divided particulate refractory material, such as zircon powder or silica powder, has been used as an insulating coating, see U.S. Pat. No. 1,662,354 to Harry M. Williams, and employed with centrifugal casting, see U.S. Pat. No. 3,527,285 to Fred J. Webbere.

Also in rotary casting of iron pipe as seen in U.S. Pat. No. 4,058,153 (Pierrel), a coating is used for protection of centrifugal casting molds for cast iron pipes. The insulating coating comprises of powder refractory materials such as silica and bentonites in a suspension.

Prior art insulating coating materials as described above are often dispersed in water suspension and sprayed onto the mold. A drawback of a water suspension coating is that considerable water vapor and maybe some hydrogen are generated in a flash when the high temperature molten metal is poured into contact with the mold coating. The water vapor and gases generate bubbles which blow into the casting forming gas holes and otherwise compromising the strength and integrity of the cast product. In the casting industry these holes are often called pin-holes, leaks, blows and gas-holes.

Similarly gas from organic suspension agents, inorganic suspension agents or wetting agents employed in some prior art insulating coatings produce hydrogen, The hydrogen expands and blows out of the insulating coatings into the casting product forming pin-holes and resulting in a loss of pressure tightness therein. Such defects can either cause pipe castings to leak upon solidification, or the pinholes may just result in a shorter life expectancy for the mold. Accordingly the defective pipe castings must be scrapped resulting in higher average manufacturing costs per unit of good product because of the lost labor, core materials, overhead and lost production time.

Another prior art method of providing a protective insulating thermal barrier on molds is a technique referred to as "dry spray". As disclosed in U.S. Pat. No. 1,949,433 to Norman F. S. Russell et al, such methods employ a carrier gas to move the particulate refractory material onto the active mold surface immediately in advance of the metal being cast. This coating method depends upon centrifugal force to establish and maintain a coating layer of the refractory material on the mold. Since no water is used in this coating technique fewer pinhole problems arise on account of lower gas content in the coating. Pinholes and leaks still occur however in iron castings manufactured with this dry spray process because the metal turbulence during spraying allows carbon monoxide and carbon dioxide induced pinholes to form. Also, the "dry spray" is difficult to uniformly distribute and maintain over the surface of the mold when the metal is sprayed.

Still other prior art insulating coatings have employed resins and organic adhesives for bonding refractory materials onto the active mold surface. The resins and organic adhesives upon being heated by the molten metal become chemically reactive forming blowout gases, such as hydrogen, carbon monoxide, and carbon dioxide. The only way to vent the volume of these gases out of the mold is to drill hundreds or thousands of holes into the back side of the mold.

In addition, these blowout gases from said resins and organic adhesives such as carbon monoxide are toxic and environmentally objectionable. As environmental concerns in the United States increase, the release of potentially harmful gases are likely to become more and more regulated. Similarly, refractory materials for insulating coatings in the past have been suspended in alcohol and other organic solvents. There is a preference to limit the use of organic solvents because of their effects on the atmosphere, their flammability and explosion potential.

When prior art water-based insulating coatings are applied to the surface of a mold cavity most of the carrier water evaporates on account of the elevated temperature of molds during casting. In centrifugal pipe casting the temperature of the mold at its active cavity surface is typically in the range of 400° F.-600° F. In prior art casting molds, a not insignificant amount of water remains in some existing pores of the prior art coatings. In addition a not insignificant amount of water is chemically bound to certain types of compounds in the prior art insulating coatings. This not insignificant amount of water remains in the insulating coating even after an extended period of time and remains until the coating temperature becomes much higher, a temperature somewhere above 1,200° F. In many metal casting processes the temperature of the molten metal is higher than 1,200° F., for instance molten iron alloy temperatures are in the range of 2,300° F.-2,500° F. This remaining water vaporizes upon contact with the molten metal to form blowout gases. Pinholes and/or other defects arise in the castings formed by prior art molds on account of these blowout gases.

SUMMARY

An object of this invention is to produce metal castings having an improved surface quality without pinholes and dimples caused by blow out gases.

The present invention provides for an improved mold insulating coating for use in producing metal castings. The manufactured metal castings are of high metallurgical quality, solid and clean with very limited pinholes through the casting wall and very limited dimples on the surface of the casting.

The present invention consists of a water based suspension coating wherein water vapor and sometimes gases are only generated when the insulating coating is first applied to a heated mold active surface and for a short period of time thereafter. With insulating coatings of the present invention none or just a minimal amount of blowout gases are formed when the insulating coatings are subjected to the much higher temperatures of the molten metal during pouring.

A metal casting product employing a present invention coating during manufacturing has improved metallurgical bonds throughout the finished metal casting product.

The present invention coating creates a thermal barrier to limit the rate of heat transfer into the permanent mold and thus contributes to increasing the useful life expectancy of a permanent mold.

The volume of pinholes and other gas defects formed in casting products caused by blowout gases are reduced or nearly eliminated by molds having the present invention insulating coating applied thereto. The present invention coating minimizes the casting products that may need to be scrapped.

The present invention's insulating coatings applied onto the active surface of molds are adequately strong and uniform, and are not penetrated by the molten metal being cast.

A further object of the present invention is to provide a coated mold for producing clean metal castings of high quality from molten metal.

A mold coated with the present invention can be employed for casting many more products than the same mold coated with prior art insulating coatings. The present invention coatings greatly inhibit the deterioration of the active wall surface of the mold.

Refractory glass makes for a good material for use in insulating permanent metal molds on account of its good heat resistant qualities, low thermal conductivity, and reduced gas evolution during contact with molten metal.

The refractory glass employed for the present invention coating is an amorphous (non-crystalline) brittle solid and has limited internal porosity and low surface attraction for water relative to existing conventional mold insulating coating compositions. Many of the current conventional refractory compositions used to insulate the active surface on molds have a crystalline structure.

An object of the present invention is to mix together an insulating coating material that is available and is a low cost alternative in comparison to the existing prior art coating materials employed in the metal casting industry.

The present invention seeks to provide an improved mold coating material and a process for providing a permanent mold with an improved mold coating and casting product surface finish.

The refractory glass employed and incorporated into the present invention insulating coating is selected so as to have a glass transition temperature near or above the temperature of the molten metal being poured.

A particular advantage of the smoother casting product exterior surface in the present invention coating method is that finish machine time and tooling costs are reduced significantly in comparison to prior art practices. Employing the present invention coating method results in smoother casting products that can be manufactured closer to their final dimensions without the need for additional tooling.

Other objects and advantages of the present invention will become apparent from the detailed description of preferred embodiments which follow.

DETAILED DESCRIPTION

The present invention is a thermal insulating coating to be applied to permanent molds used in metal casting productions. The coating is applied to the active surface of a permanent mold to protect the mold from deteriorating on account of the heat transferred from the molten metal to the active portion of the mold during casting process. The insulating coating of the present invention is in a form of a liquid suspension mix and may be applied to the active surface of the mold by rolling, by brush, mopping, spraying, dipping or other well known suitable means.

U.S. Pat. No. 3,437,131, to Ornitz, discloses a method of spraying insulating coating on an active surface of the centrifugal casting mold and is hereby incorporated by reference in its entirety. U.S. Pat. No. 3,945,782 to Farahar also discloses a method of spraying insulating coating on a centrifugal casting mold and is hereby incorporated by reference in its entirety.

The term glass, as employed in the present invention, refers to an amorphous (non-crystalline) solid material formed by rapidly quenching a liquid metal oxide or combination of oxides. The term glass as used herein shall be defined in a much wider sense and not limited to the ubiquitous silica based glass compositions used for centuries to manufacture drinking cups, reading glasses and windows. The term glass as used herein includes every solid material that possesses non-crystalline compounds. Such compounds may or may not have a glass transition temperature at some point below the melting point.

Glass transition is the transition in an amorphous material having a hard relatively brittle state to a rubbery liquid state. This transition occurs at a temperature lower than the melting temperature of the material. In the present invention the glass transition temperature for any selected insulating coating material must be near or slightly higher than the temperature of the molten metal being cast so that the glass does not transition into a rubbery liquid state during pouring of the molten metal. If the insulating coating temperature should rise into the glass's rubbery liquid state temperature range, the coating would potentially dislodge from the mold or otherwise shift and flow along the active mold surface. An uneven distribution of the glass coating could result in accelerating thermal damage to the mold and a rough uneven outer surface of the casting product as well. Accordingly, the present invention contemplates only using glass compounds that maintain a brittle state at or above the temperature of the molten metal being poured. In addition the refractory glass employed in the present invention is selected so as to be nonreactive and inert during casting. Numerous high temperature refractory glass compounds are well known in the art, many of which are based on silica-lime-alumina solutions.

According to the present invention these objectives outlined above can be attained during the manufacture of iron alloy pipe by centrifugal casting, wherein the iron alloys have a 2,300° F.-2,500° F. pouring temperature. Ranges of glass compounds used in a glass composition suspended in a water based coating of the present invention are shown in Table 1 below. Any glass composition consisting of the glass compounds falling within the ranges set forth in Table 1 would be suitable for use with iron alloy castings. The refractory glass compounds shown below are inert, nonreactive and maintain a brittle state during the entire centrifugal casting process. The following table, Table 1, illustrates present invention refractory glass compounds used in compositions for coating a centrifugal casting mold in the production of iron alloy pipe.

TABLE I

| Chemical Compound | Percent Weight % |
|---|---|
| $SiO_2$ | 35-45% |
| $Al_2O_3$ | 8-15% |
| CaO | 25-35% |
| MgO | 7-13% |
| $Fe_2O_3$ | 3-7% |
| $TiO_2$ | 1-2% |

The preferred suspension carrier liquid for all of the present invention coating compositions disclosed herein is distilled water. In an alternative present invention coating the water used for the carrier liquid may be purified by reverse osmosis to eliminate contaminants that may allow fungi to grow in the suspension carrier liquid. Clean water is beneficial in extending the shelf life of the present water-glass suspension mix. Contaminated water that has not been cleaned or distilled may allow algae, bacteria, fungi or other undesirable living organisms to grow in the suspension.

The pipe mold during the iron alloy pipe centrifugal casting process maintains a temperature within a range of between 300° F.-600° F. During this centrifugal casting operation, the pipe mold active surface is generally at about 400° F. and will rise above 400° F. when a casting is made. Thus, the mold temperature is maintained by successive casting cycles. The carrier water from the coating suspension is vaporized shortly after spraying the water-glass suspension mix onto the active surface of the mold. The water vapor gas is evolved from the warm mold, so no additional blowout water vapor gases are generated when the hot molten metal is applied onto the active surface of the mold.

As previously indicated, during centrifugal casting of iron pipe the mold is heated to between 300° F.-600° F. by the molten metal applied onto the mold during a previous casting cycle. For the first casting cycle occurring in a new production order, if the mold is at room temperature or otherwise below 300° F., it is desirable to preheat the mold to within the temperature 350° F.-600° F. range. The mold for instance could be preheated by placing the mold in a furnace or producing a few castings on a cold mold to heat it up to the desired operating temperature.

In accordance with the present invention the coating is made of a glass-water suspension mix. The glass employed in the present invention is ground or otherwise pulverized into particles having a size less than 10.0 microns. The amount of glass composition in the suspension mix ranging between 10%-55% by weight; a second alternative coating suspension mix constitutes a glass composition in the range of between 20%-45% by weight; a third alternative coating constitutes a glass composition ranging between 30%-45% by weight; and a fourth preferred embodiment constitutes a glass composition of about 45% by weight. For each of the four immediately above identified coating suspensions, the water constitutes most of the remaining balance by weight of the coating suspension except for small amounts of binder and/or wetting agents. Said wetting agents and/or binders total less than approximately 5.0% by weight in the four coating suspensions identified immediately above. Alternatively, said wetting agents and binders may range between 1.5% to 5.0% by weight in each of the four coating suspensions identified immediately above. In further alternative coating suspensions said wetting agents and binders may range from 1.0% to 3.0% by weight in each of the four suspensions identified immediately above. In other preferred alternative coating suspensions wetting agents and binders may range from 1.5% to 2.5% by weight in each of the four suspensions identified immediately above. In yet still further preferred alternative coating suspensions said wetting agents and binders may range from 0.1% to 4.0% by weight in each of the four suspensions identified immediately above. In each of all the above identified coatings suspensions the glass particles may alternatively have a size less than 5.0 microns.

Well known bentonites referred to as southern or western bentonites or other similar Bentonite may be used as the binder in the insulating coatings of the present invention. Suitable wetting agents in the present invention include DAWN hand soap, and special chemical wetting agents such as ACUME 9300 manufactured by Rohm and Haas, and RHODOLINE 207 manufactured by Rhodie.

In accordance with additional preferred present invention coating glass-water suspension mixes, the amount of glass composition in the suspension mix ranges between 10%-55% by weight; another preferred alternative coating suspension mix constitutes in the range of between 20%-45% by weight a glass composition, a still another preferred alternative coating suspension mix constitutes glass ranging between 30%-45% by weight; and still yet another preferred embodiment comprises about 45% glass by weight. In these four immediately above described glass-water suspensions of the present invention the water constitutes the entire remaining balance of the coating suspension by weight. Wherein the glass particle size in these immediately above coating suspensions, having only water and glass, the glass particles have a particle size of less than 3.0 microns. No binder or wetting agent is necessary to improve adherence of the immediately above described coating suspensions to a mold whenever using these smaller glass particles. These smaller glass particle-water suspensions of the present invention can be satisfactorily applied to the active surface of molds without the need for any binder or wetting agent.

Any glass composition of the present invention set forth in Table 1 is more dense than water but the settling rate of any such waterborne composition meeting the limitations of Table 1 is relatively low, so long as the dispersed glass has a relatively small particle size. Continuous stirring is sufficient to prevent settling. Suspending agents also can be used to retard settling. Alternatively grinding the glass to even smaller particle sizes of about 3.0 microns or less will inhibit settling almost completely without a need for stirring. As a result of minimizing or eliminating the suspending agent, the amount of moisture evolved into gas during a loss on ignition (LOI) test conducted at 1,800° F. is less compared to solutions containing more suspending agent. Accordingly it is preferred to have glass particle sizes smaller than 3.0 microns or to employ stirring.

Likewise it is also desirable to minimize the amount of wetting agent and binder to that necessary to form a good adhesion of the refractory glass to the active surface of the mold to limit any potential for blowout gases. The binder and wetting agent compositions may become volatile and/or form blowout gas during pouring Generally the coating suspensions of the present invention employing a glass compositions as set forth in Table 1 above and as described herein provide a suitable insulating coating for centrifugal casting molds used in manufacturing pipe from metals having a melting point between 2,000° F. and 2,850° F. For example the present invention water-glass suspension coating is suitable for molten metals selected from the groups consisting of Ductile Iron and gray irons of a wide variety of compositions, and Bronze of a wide variety of compositions.

The present invention coating is useful for thermally insulating permanent molds used in centrifugal pipe casting processes. Centrifugal casting is a well known method of making metal tubes including iron pipe. U.S. Pat. No. 4,116,260, to Pierrel, U.S. Pat. No. 4,370,719 to Upchurch and U.S. Pat. No. 4,448,610, to Bellocci, each disclose a method of centrifugal casting piping/tubing and are hereby incorporated by reference in their entirety.

In the present invention the insulating coating is applied onto the pipe centrifugal casting mold at approximately from 0.010 to 0.040 inches thick and preferably approximately 0.010 to 0.020 inches thick. The required thickness may vary however depending on the pouring temperature and geometry of the metal being cast. For example, thicker castings may require a thicker coating to achieve the desired amount of thermal protection.

The present invention coating suspensions having the preferred thickness of approximately 0.010 to 0.020 inches take only approximately three minutes to dry when applied to a mold heated at between 400° F.-450° F. After drying a present invention coating at a temperature of between 400° F. to 450° F. for approximately three minutes, any existing water, moisture and other coating materials that have potential for creating blowout gases have already been vaporized into a gas and dispersed into the environment. Less time is required for drying thinner coatings. During the molten metal application onto the coated mold and throughout the solidification of the casting pipe product no blowout gases are generated that could form pinholes in the surface of the pipe product casting.

Once solidified, the pipe casting is then retrieved from the centrifugal casting mold. The coating of the present invention no longer adheres to the active surface of the centrifugal pipe mold and is usually removed as the pipe is extracted. Otherwise, it can be removed by manual means well known in the art, including by wire brushing. It is believed that the present invention coating becomes easy to remove from the active mold surface after it has been subjected to the higher temperatures of the molten metal. It is believed that the present invention insulating coating loses its adhesive properties at higher molten metal temperatures, is removed from the mold with the casting, and is not built up on the mold with repetitive casting cycles.

The thickness of the insulating coating can be varied according to the metal being cast, and the length, thickness and diameter of the pipe being cast. In addition it is appreciated that the insulation rating of the refractory glass composition being used should be taken into consideration because it influences the required coating thickness needed to prevent the mold from overheating in a detrimental manner.

The present invention centrifugal casting method described immediately above is particularly useful for casting articles, such as cylinder liner blanks, from grey iron.

Preferred embodiments of the present invention for use on metal molds have just been described and illustrated above. It is to be understood that these descriptions, may be modified without departing from the concepts of the present invention.

The present invention glass-water based coatings may also be useful as a coating for sand molds and sand cores to prevent aluminum, bronze, gray iron, ductile iron, and steel from adhering to the sand mold or sand core. Sand molds may have more complex shapes than permanent molds and may have cores to from internal cavities. It is contemplated that it would be beneficial for these passages and holes to produce smooth surfaces. The present invention coatings could be applied onto the active surface of cores used for forming oil or water passages in engine blocks. It is contemplated that these engine block cores are coated with the present invention coatings to thermally insulate and protect the cores from thermal cracks and other adverse effects.

The size distribution of the glass material applied to a sand mold or core can be much larger than that applied to a metal mold, and in fact may have a fiber shape. An acceptable fiber shape for use on a sand mold or core has a diameter of from 1.0 to 5.0 microns and a length of up to 1000.0 microns. A glass-water suspension containing from 10 to 25% glass fiber by weight when applied to the active surface of a core provides an interlocking fiber mat coating that prevents the molten metal from penetrating to the core's active surface. The fiber mat coating inhibits a rough surface on both the casting and the active core surface.

Those familiar with metal casting processes will recognize that this invention can also be applied to methods and apparatus used for producing parts made from non-ferrous metals.

The invention also contemplates a mold in combination with such a mold coating. While generally the coating is employed in combination with a metal mold, it may also be employed in combination with other molds, such as graphite and ceramic molds.

In the present invention the refractory glass can be suspended in one of a variety of materials other than water as described above, including denatured alcohol and mineral spirits. However on account of the harmful and dangerous nature of organic liquids, the preferred carrier liquid is water.

While certain novel features of this invention have been shown and described, it is not intended to be limited to the details above, since it will be understood that various omissions, modifications, substitutions and changes in the forms and details of the coating can be made by those skilled in the art without departing in any way from the spirit of the present invention.

The invention claimed is:

1. A process for manufacturing a metal casting free from pinholes and other blowout gas defects comprising, providing a mold, said mold having an active surface, heating and maintaining said mold to a temperature between 250° F.-600° F., prior to introducing a molten metal at an elevated temperature into said mold, a coating suspension mix is applied onto said active surface of said mold, said coating suspension mix having dispersed therein a quantity of refractory glass that constitutes from 10.0% to 55.0% by weight of the coating suspension mix, said refractory glass being inert at said elevated temperature of said molten metal to be cast and having a brittle state at said elevated temperature of said molten metal, said suspension mix having a carrier liquid for suspending said quantity of refractory glass, wherein said carrier liquid and said refractory glass combined constitute at least 95.0% by weight of the suspension mix, wherein said refractory glass is nonporous to said carrier liquid and said carrier liquid is vaporizable at a temperature from 250° F. to 600° F., drying said carrier liquid on said heated mold for at least five minutes in duration whereby said carrier liquid is vaporized and no further water vaporizes or are other gases generated, after said five minutes a thermal insulating coating remains on said mold active surface, said thermal insulating coating is inert and nonreactive to said molten metal.

2. A process according to claim 1, wherein said application of said suspension mix onto the active surface of the mold is in the form of a thin smooth layer, said thin smooth layer upon said drying forms a dry thermal insulating coating having a thickness of 0.01 inch to 0.04 inches on said active surface.

3. A process according to claim 2, wherein said molten metal temperature is at least 1,200° F.

4. A process according to claim 1, wherein said mold is a centrifugal casting mold.

5. A process according to claim 1, wherein said suspension mix is applied by spraying.

6. A process according to claim 1, wherein said molten metal is molten iron, said process further comprising pouring said molten iron into said centrifugal casting mold.

* * * * *